United States Patent [19]

Cabral

[11] 4,252,345

[45] Feb. 24, 1981

[54] SKATE GUARD AND WALKER

[75] Inventor: Brian J. Cabral, New Bedford, Mass.

[73] Assignee: Southeastern Bank and Trust Company, New Bedford, Mass.

[21] Appl. No.: 22,641

[22] Filed: Mar. 21, 1979

Related U.S. Application Data

[63] Continuation-in-part of Ser. No. 5,447, Jan. 22, 1979, abandoned, which is a continuation-in-part of Ser. No. 968,380, Dec. 11, 1978, abandoned.

[51] Int. Cl.[3] ..... A63C 3/12

[52] U.S. Cl. ..... 280/825

[58] Field of Search ..... 280/11.12, 11.38, 11.18, 280/11.32, 11.34, 809, 825

[56] References Cited

U.S. PATENT DOCUMENTS

| | | | |
|---|---|---|---|
| 1,265,994 | 5/1918 | Brown | 280/11.32 X |
| 2,213,966 | 9/1940 | Nygaard | 280/11.18 |
| 2,395,394 | 2/1946 | Carlson | 280/11.38 |
| 2,642,291 | 6/1953 | Condon | 280/11.38 |
| 2,954,572 | 10/1960 | Skrainka | 280/11.38 X |
| 3,934,892 | 1/1976 | Baikie | 280/11.12 |

*Primary Examiner*—John J. Love
*Assistant Examiner*—Michael Mar
*Attorney, Agent, or Firm*—Robert T. Gammons

[57] ABSTRACT

A skate guard and walker comprising an elongate shoe containing an elongate groove for receiving the blade of a skate and heel and toe posts at the ends of the shoe containing forwardly and rearwardly-inclined recesses for receiving the ends of the blade and supporting frame, the heel and toe posts being relatively movable longitudinally of the shoe and a bolt associated with the heel post for adjustably fixing the position of the heel post in relation to the toe post.

18 Claims, 15 Drawing Figures

SKATE GUARD AND WALKER

BACKGROUND OF THE INVENTION

This is a continuation-in-part of application Ser. No. 005,447, filed Jan. 22, 1979 now abandoned, which is a continuation-in-part of application Ser. No. 968,380, filed Dec. 11, 1978 now abandoned.

One kind of skate guard and walker is an elongate rubber or plastic strip containing a groove for receiving the blade at one end of which there is an upturned post for receiving the forward end of the blade and at the heel end of which there is a series of longitudinally-spaced, transversely-aligned holes for receiving a pin for holding the guard engaged with the blade. Another kind is provided with a strap or spring at the heel end. Neither kind provides a clamp part adjustable to the length of the skate and in said position of adjustment clampable to the blade so that the blade cannot be moved without releasing the part and retracting it. It is the purpose of this invention to provide a rigid or semi-rigid skate guard which is especially designed for use with skates of the kind shown in U.S. Pat. No. 3,934,892, and for most hockey skates, which can be rigidly clamped to the ends of the skate, can be tailored to the length of the skate with which it is to be used and which, in addition to protecting the blade, enhances walking and is inexpensive to manufacture.

SUMMARY OF THE INVENTION

As herein illustrated, the skate guard and walker comprises a rigid or semi-rigid elongate shoe containing an elongate groove for receiving the blade of the skate and heel and toe posts at the opposite ends of the shoe containing forwardly and rearwardly-inclined grooves for receiving the forward and rear ends of the skate blade and supporting frame, said heel and toe posts being relatively longitudinally adjustable and means for clamping the heel and toe posts at a predetermined position of adjustment. In the preferred form, the toe post is stationary and the heel post movable longitudinally of the shoe and, for this purpose, the shoe contains a longitudinally-extending slot and the heel post is slidably connected to the shoe by means of a bolt extending through transversely-aligned holes in the heel post and through the longitudinally-extending slot in the shoe. Desirably, the aligned holes in the heel posts are positioned forwardly of the back line of the groove in the heel part. The bottom surface of the shoe is transversely flat and has a longitudinal curvature such as to facilitate walking. The shoe may be shortened by cutting off a portion at the heel and inserting a plug to fill the open end of the longitudinally-extending slot. Optionally, the shoe may have longitudinally-spaced holes and the heel post slots for alignment with the selected holes through which a clamp bolt may be secured, in which event, the shoe may be shortened by cutting between holes so that a plug is not required.

The shoe may be of solid cross section or of hollow cross section comprised, for example, of metal tubing or extruded plastic tubing. Preferably, the shoe is injection molded of a plastic such as a high density polystyrene, polypropylene or ethylvinyl acetate. When made tubular and shortened, a plug is provided to close the open heel end.

The invention will now be described in greater detail with reference to the accompanying drawings, wherein.

Figure 1:
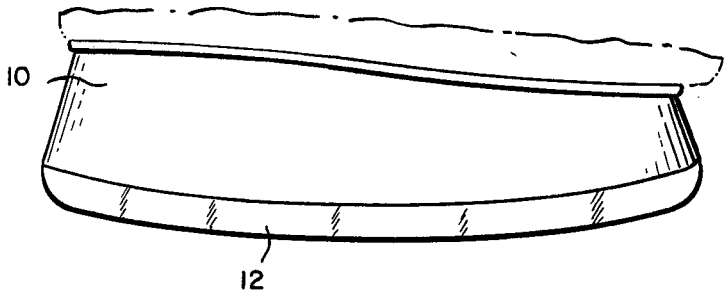
FIG. 1 is a side elevation of the type of skate for which the skate guard and walker of this invention is particularly designed.

Referring to the drawings, the skate guard and walker of this invention is designed for clamping to the ends of hockey skates and skates of the kind shown in U.S. Pat. No. 3,934,892 wherein, as shown in FIG. 1, the frame 10 of the skate is coextensive with the blade 12 so the blade does not protrude beyond the ends of the frame nor are there through openings at the ends between the upper edge of the blade and the frame by means of which conventional skate guards can be secured sufficiently firmly to enable walking. As can be seen by reference to the aforesaid patent, the frame of the skate is of molded construction and its ends are transversely-rounded so that the conventional skate guard will not fit to the ends nor remain attached thereto.

The skate guard of this invention is designed to be securely attached to skates of the kind shown in U.S. Pat. No. 3,934,892 and comprises a rigid or semi-rigid elongate shoe 14 containing in its top edge a longitudinally-extending groove 16 for receiving the blade of the skate and heel and toe posts 18 and 20 at its opposite ends which contain, respectively, forwardly and rearwardly-inclined grooves 22 and 24 for receiving the ends of the blade and the rounded ends of the frame of the skate. The toe post 20 is preferably stationary and the heel post 18 is longitudinally adjustable so as to enable adjusting it relative to the toe post for skates of different size. To provide for adjustment of the heel post 18, the latter is provided with horizontal surfaces 26—26 for sliding engagement with the top of the shoe at opposite sides of the groove 16 and spaced, parallel parts **18*a*—18*a* defining downwardly-extending surfaces 28—28 for sliding engagement with the sides of the shoe and the latter are provided with transversely-aligned holes 30—30 for receiving a bolt 40 for longitudinal sliding engagement within a longitudinally-extending through slot 42 in the shoe parallel to the top of the shoe. Desirably, the holes 30—30 are positioned forwardly of the back line of the groove 22 in the heel post. The bolt 40 has at one end a head 46*a* and at the other end a nut 46b** by means of which the side pieces of the heel post may be drawn into clamping engagement with the opposite sides of the shoe to fix the latter at a predetermined position of adjustment.

The bottom surface 48 of the shoe 14 is transversely flat. However, to facilitate walking, it is provided with a longitudinally-arcuate contour to provide a rocker-like surface 50 to walk on. Preferably, this surface has a radius or curvature of approximately 9 feet.

Figure 7:
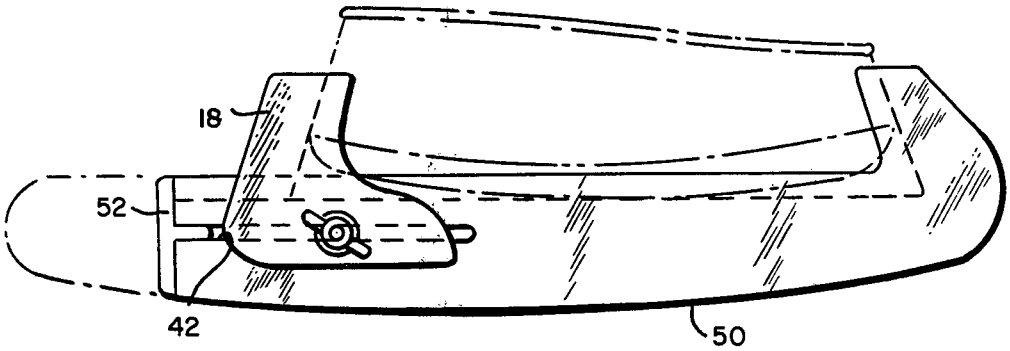
FIG. 7 is a fragmentary elevation showing shortening of the shoe illustrated in FIGS. 1 to 6 inclusive.

It may be desirable to shorten the shoe if the heel post is moved forwardly in the slot into engagement with the heel end of a smaller size skate. If this is so, the shoe can be cut off, for example, as shown in dot and dash lines in FIG. 7, to remove an appropriate length and a plug 52 inserted and secured in the open end of the slot with glue or some appropriate fastening means.

Figure 8:
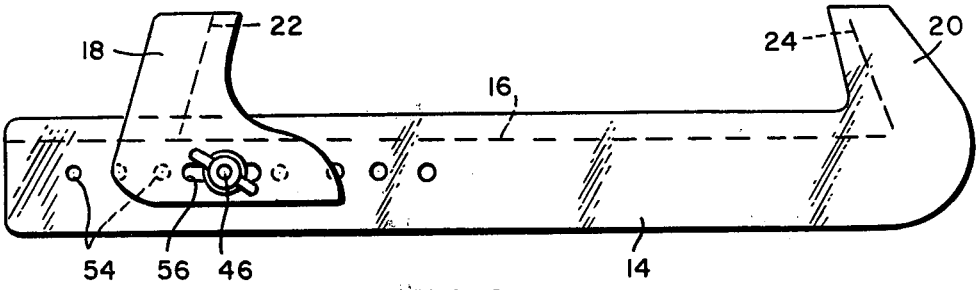
FIG. 8 is an elevation of an alternative form of shoe provided with longitudinally-spaced holes in place of the longitudinal groove for adjustment of the heel post relative to the toe post.
Figure 9:
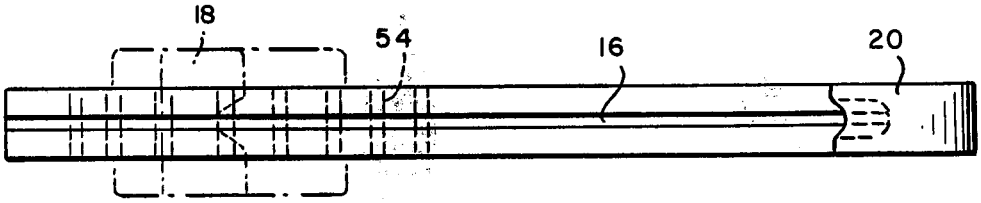
FIG. 9 is a plan view of FIG. 8.

A modification especially adapted to be fitted to a range of sizes from large to small skates is shown in FIGS. 8 to 11. In FIG. 8, the shoe 18 contains transversely-extending holes 52. The toe post 20 is stationary, being fastened to the forward end of the shoe in appropriate fashion and the heel post 18 is provided with slots 54 for alignment with a selected hole 52 and clamped at the desired distance from the stationary post by means of a clamp bolt. In this form, the shoe can be appropriately shortened by cutting between the holes 52 so that there is no need for a plug. When constructed as shown in FIGS. 8 and 9, the ground engaging surface is preferably straight rather than arcuate as shown in FIGS. 1 to 7.

Figure 10:
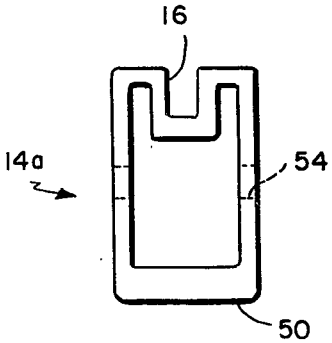
FIG. 10 is a transverse section of a hollow shoe.
Figure 11:
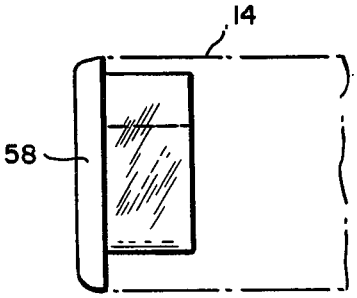
FIG. 11 is an elevation of a plug for insertion into the open end of a hollow shoe such as shown in FIG. 10.
Figure 13:
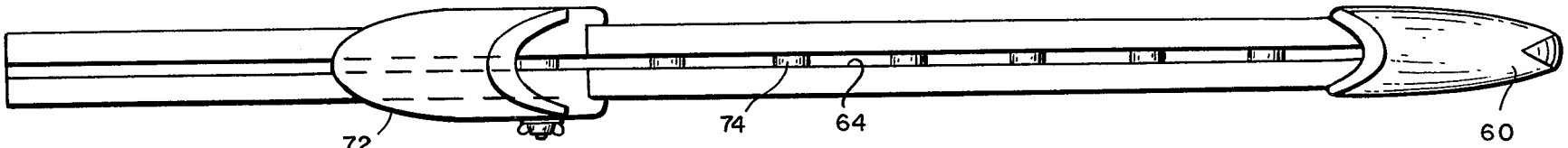
FIG. 13 is a plan view of the top side of the skate guard shown in FIG. 12.
Figure 12:
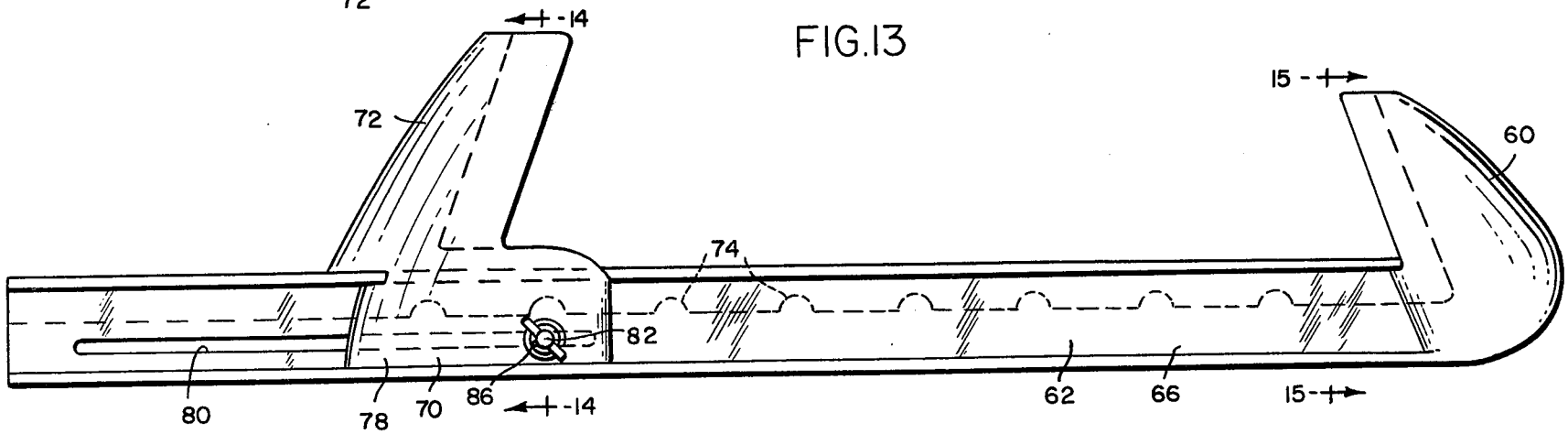
FIG. 12 is a side elevation of an injection molded skate guard.
Figure 15:
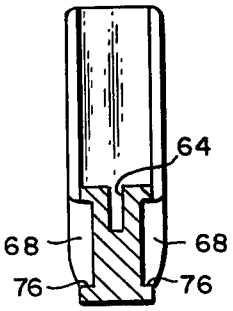
FIG. 15 is a section taken on the line 15—15 of FIG. 12.
Figure 14:
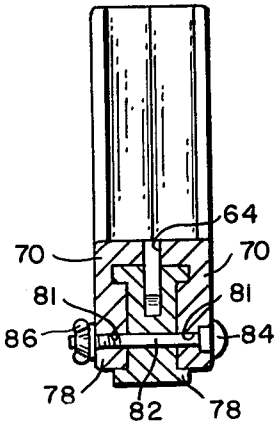
FIG. 14 is a section taken on the line 14—14 of FIG. 13.

The shoe may be made hollow, for example, a metal tube of generally rectangular cross section, FIG. 10, having a straight lower side 50. The top side contains a groove 16 for receiving the blade. The toe post is fitted into the forward end and welded and the heel post is slidably mounted to the heel end. Slots are provided in the heel post, spaced holes along the shoe, and a clamp bolt for securing the heel post at the desired position relative to the toe post as related with respect to FIGS. 8 and 9. The heel end of the tubular shoe is desirably closed with a cap 58 and if a portion of the heel is cut off to shorten the shoe for a particular length skate, a cap may be inserted into the open heel end and secured by crimping or the like.

Instead of metal, the shoe may be a tubular plastic extrusion. When the heel end of such a plastic extrusion is cut off, a plastic plug may be cemented into the open end.

A preferred form of skate guard and walker is shown in FIGS. 12 to 15 inclusive made by injection molding of a suitable plastic, for example, a high density styrene, polypropylene, ethylvinyl acetate and the like. The toe post 60 is injection molded to the blade 62 and the latter has longitudinally of the top side a narrow groove 64 for receiving the blade and at its opposite sides recessed grooves 66—66 for receiving protrusions 68—68 at the inner sides of the downwardly-extending portions 70—70 of the heel post 72. The lower sides of the grooves 68—68 provide horizontal shoulders 76—76 on which slidingly rest the lower edges 78—78 of the downwardly-extending portion 70 of the heel post. The bottom of the groove 64 is provided with longitudinally-spaced, upwardly-convex protrusions 74. Both the toe and heel posts are contoured internally to fit the ends of the skate and externally to afford an attractive profile.

Figure 2:
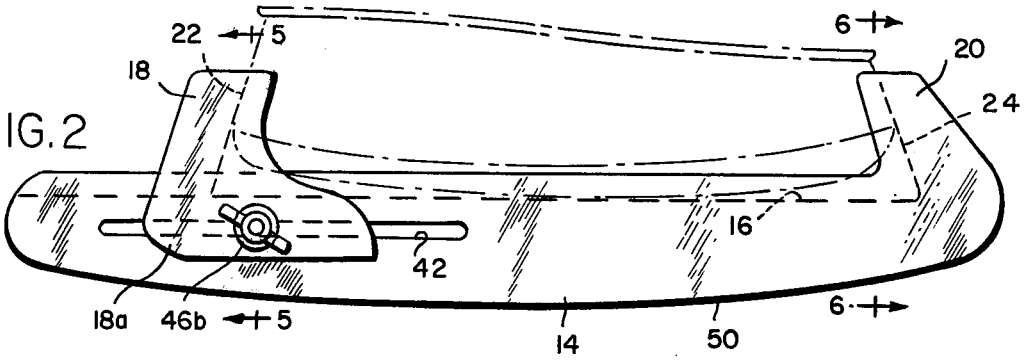
FIG. 2 is a side elevation of the skate guard and walker showing the skate in dot and dash lines.
Figure 3:
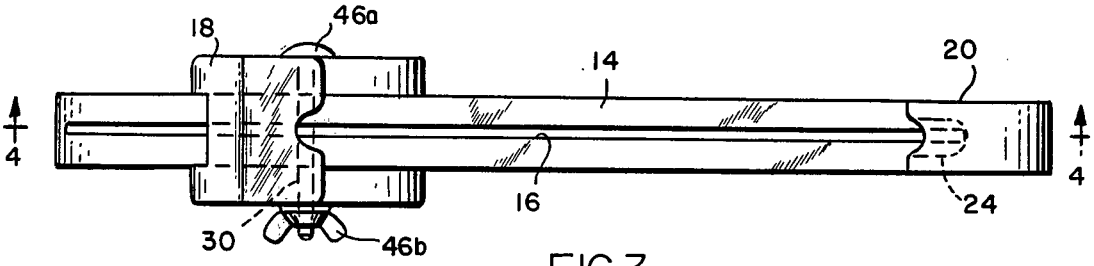
FIG. 3 is a plan view of the top side of the skate guard and walker shown in FIG. 2.
Figure 4:
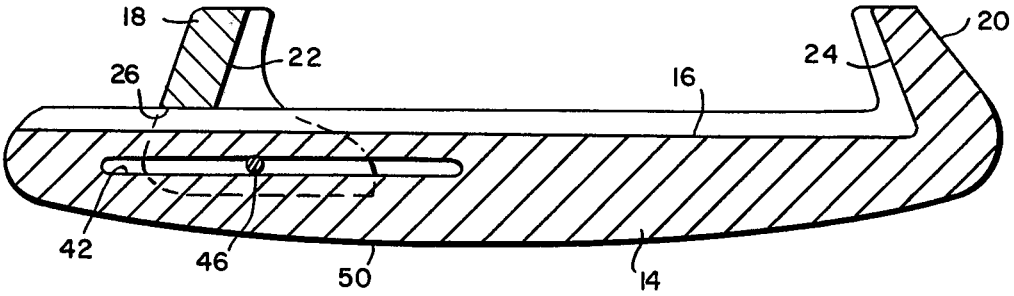
FIG. 4 is a longitudinal vertical section.
Figure 5:
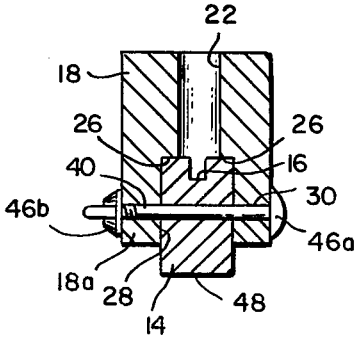
FIG. 5 is a transverse section through the heel posts.
Figure 6:
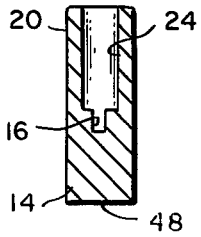
FIG. 6 is a transverse section through the toe posts.

As in the form of the invention shown in FIGS. 2 to 4 inclusive, the shoe is provided with a longitudinal slot 80 and the downwardly-projecting sides 70—70 of the heel post contain openings 81—81 for receiving a bolt 82 provided with a head 84 at one end and threaded at the other end to receive a thumb nut 86 which thus enables adjusting the heel post along the slot to the length of the skate and fixing it in a position of adjustment. Optionally, of course, the slot may be replaced with a row of spaced holes as disclosed in FIGS. 8 and 9.

As thus constructed, the skate guard and walker in its several forms serves to protect the skates for storing, facilitates walking on any surface, will fit to any size skate and especially fits skates of the kind shown in U.S. Pat. No. 3,934,892.

It should be understood that the present disclosure is for the purpose of illustration only and includes all modifications or improvements which fall within the scope of the appended claims.

I claim:

1. A skate guard and walker for a shoe skate of the kind wherein the blade of the skate is attached to the shoe bottom by means of a support structure substantially coextensive in length with the blade, which structure has side walls which diverge outwardly and upwardly from the blade toward the bottom of the shoe, and ends which increase in width from the blade toward the bottom of the shoe, comprising an elongate blade-receiving member containing in its upper longitudinal edge an elongate blade-receiving groove of uniform width corresponding in thickness to the blade, said groove being closed at the toe end and open at the heel end, a stationary toe post at the toe end of the blade-receiving member, a heel post adjustably mounted on the blade-receiving member for sliding movement therealong relative to the toe post to vary the distance between the toe and heel posts for skates of different blade lengths, said toe and heel posts defining, respectively, upwardly-extending grooves inclined rearwardly and forwardly, respectively, said grooves increasing in width from the width of the blade-receiving groove toward the upper ends of the respective posts for receiving said ends of the supporting frame which increase in width from the blade toward the bottom of the shoe and means for adjustably securing the heel post to the blade-receiving member at a predetermined spacing from the toe post.

2. A skate guard and walker according to claim 1 wherein the blade-receiving member contains a transverse slot longitudinally thereof and a bolt extending through the heel post and the slot provides for fixing the heel post at a predetermined position of adjustment.

3. A skate guard and walker according to claim 2 wherein the heel post has a bearing surface slidably engaged with the top surface of the blade-receiving blade and spaced, parallel side parts slidably engaged with the opposite sides of the shoe and said side parts contain transversely-aligned holes at the level of the slot for receiving the bolt.

4. A skate guard and walker according to claim 2 wherein the heel post straddles the blade-receiving member having a part slidably engaged with the top of the blade-receiving member and spaced, parallel downwardly-extending parts slidably engaged with the side of the blade-receiving member, said side parts containing transversely-aligned holes situated at the level of the slot and forwardly of the back line of the recess within which the bolt is received.

5. A skate guard according to claim 2 wherein the grooves in the respective toe and heel posts are transversely arcuate and increase in radius of curvature from the blade-receiving groove to the upper ends of the respective posts.

6. A skate guard and walker according to claim 1 wherein the bottom surface of the blade-receiving member has a radius of curvature of approximately 9 feet.

7. A skate guard according to claim 1 wherein the elongate blade-receiving member contains longitudinally-spaced holes which extend transversely therethrough and there is means associated with the movable post engageable with a selected one of the holes to fix the heel post at a predetermined distance from the toe post.

8. A skate guard according to claim 7 wherein the blade-receiving member is of sufficient length to accommodate a skate of maximum blade length and is adapted to be cut transversely between holes to fit a skate of lesser length.

9. A skate guard according to claim 1 wherein the bottom surface of the shoe is straight.

10. A skate guard and walker according to claim 1 wherein the blade-receiving member is tubular and there is a plug adapted to fit into the open heel end of the tube.

11. A skate guard according to claim 10 wherein the blade-receiving member is a metal tube of generally rectangular cross section.

12. A skate guard according to claim 10 wherein the blade-receiving member is an extruded plastic tube of generally rectangular cross section.

13. A skate guard according to claim 1 wherein the blade-receiving member is rigid.

14. A skate guard according to claim 1 wherein the blade-receiving member is semi-rigid.

15. A skate guard according to claim 1 wherein the blade-receiving member contains at its opposite sides longitudinal grooves and there are means on the movable post slidably interengaged with the grooves.

16. A skate guard according to claim 1 wherein the blade-receiving member contains at its opposite sides longitudinal grooves defining longitudinally-extending shoulders and there are means on the movable post extending into said grooves and slidingly supported by said shoulders.

17. A skate guard according to claim 1 wherein the blade-receiving member is of substantially I-shaped cross section.

18. A skate guard according to claim 1 wherein there are longitudinally-spaced protrusions at the bottom of the elongate blade-receiving groove.

* * * * *